US009095244B2

(12) United States Patent
Jonsson et al.

(10) Patent No.: US 9,095,244 B2
(45) Date of Patent: Aug. 4, 2015

(54) DUST INDICATOR FOR A VACUUM CLEANER

(75) Inventors: Stefan Jonsson, Stockholm (SE); Fredrik Sjöberg, Bromma (SE); Henrik Troberg, Segeltorp (SE)

(73) Assignee: Aktiebolaget Electrolux (SE)

( * ) Notice: Subject to any disclaimer, the term of this patent is extended or adjusted under 35 U.S.C. 154(b) by 0 days.

(21) Appl. No.: 13/807,562

(22) PCT Filed: Jun. 28, 2011

(86) PCT No.: PCT/EP2011/060814

§ 371 (c)(1), (2), (4) Date: Mar. 6, 2013

(87) PCT Pub. No.: WO2012/000991

PCT Pub. Date: Jan. 5, 2012

(65) Prior Publication Data

US 2013/0198993 A1 Aug. 8, 2013

Related U.S. Application Data

(60) Provisional application No. 61/361,093, filed on Jul. 2, 2010.

(30) Foreign Application Priority Data

Jun. 29, 2010 (SE) ..... 1000700

(51) Int. Cl.

| | |
|---|---|
| ***A47L 9/19*** | (2006.01) |
| ***A47L 9/16*** | (2006.01) |
| ***A47L 9/28*** | (2006.01) |

(52) U.S. Cl.

CPC ..... *A47L 9/19* (2013.01); *A47L 9/1683* (2013.01); *A47L 9/2815* (2013.01); *A47L 9/2857* (2013.01); *A47L 9/2894* (2013.01)

(58) Field of Classification Search

CPC ..... A47L 9/19; A47L 9/2894; A47L 9/1683; A47L 9/2857; A47L 9/2815

USPC ..... 15/319, 339, 347

IPC ..... A47L 9/19, 9/28

See application file for complete search history.

(56) References Cited

U.S. PATENT DOCUMENTS

| | | | |
|---|---|---|---|
| 3,199,138 | A | 8/1965 | Nordeen |
| 4,601,082 | A | 7/1986 | Kurz |

(Continued)

FOREIGN PATENT DOCUMENTS

| | | | |
|---|---|---|---|
| EP | 0 327 936 | A2 | 8/1989 |
| EP | 0 347 223 | A2 | 12/1989 |

(Continued)

OTHER PUBLICATIONS

International Search Report from International Patent Application No. PCT/EP2011/060814, mailed Nov. 22, 2011.

(Continued)

*Primary Examiner* — David Redding

(74) *Attorney, Agent, or Firm* — RatnerPrestia

(57) ABSTRACT

This invention relates to a dust indicator in a vacuum cleaner, which dust indicator (200) is arranged in a wall (102) at least partly defining a space of the vacuum cleaner that is set under negative pressure with respect to the outside of the wall during operation of the vacuum cleaner. The dust indicator comprises an air channel (211) having an air inlet (212) arranged at an outer side of the wall, and an air outlet (213) arranged at an inner side of the wall, such that an airflow is directed into the space during operation of the vacuum cleaner due to the negative pressure. The dust indicator further comprises a sensor (220) arranged for detecting dust by means of sending and/or receiving an electromagnetic signal which is transmitted through the space. The air channel is arranged such that the airflow prevents dust from sticking in an area of the path of the electromagnetic signal of the sensor. The sensor is arranged behind a transparent window (232) such that it is shielded from dust and debris within said space.

20 Claims, 5 Drawing Sheets

(56) References Cited

U.S. PATENT DOCUMENTS

| | | | | |
|---|---|---|---|---|
| 4,680,827 | A | | 7/1987 | Hummel |
| 4,769,535 | A | | 9/1988 | Sasaki et al. |
| 4,920,605 | A | | 5/1990 | Takashima |
| 4,937,912 | A | * | 7/1990 | Kurz ..... 15/339 |
| 4,942,640 | A | | 7/1990 | Hayashi et al. |
| 5,134,749 | A | | 8/1992 | Sakurai et al. |
| 5,144,714 | A | | 9/1992 | Mori et al. |
| 5,144,715 | A | | 9/1992 | Matsuyo et al. |
| 5,152,028 | A | | 10/1992 | Hirano |
| 5,163,202 | A | | 11/1992 | Kawakami et al. |
| 5,182,833 | A | | 2/1993 | Yamaguchi et al. |
| 5,216,777 | A | | 6/1993 | Moro et al. |
| 5,233,682 | A | | 8/1993 | Abe et al. |
| 5,251,358 | A | | 10/1993 | Moro et al. |
| 5,319,827 | A | | 6/1994 | Yang |
| 5,323,483 | A | | 6/1994 | Baeg |
| 5,515,572 | A | | 5/1996 | Hoekstra et al. |
| 5,539,953 | A | | 7/1996 | Kurz |
| 5,542,146 | A | | 8/1996 | Hoekstra et al. |
| 5,613,261 | A | | 3/1997 | Kawakami et al. |
| 5,815,884 | A | | 10/1998 | Imamura et al. |
| 5,819,367 | A | | 10/1998 | Imamura |
| 6,023,814 | A | | 2/2000 | Imamura |
| 6,055,702 | A | | 5/2000 | Imamura et al. |
| 6,323,570 | B1 | | 11/2001 | Nishimura et al. |
| 6,400,048 | B1 | | 6/2002 | Nishimura et al. |
| 6,437,465 | B1 | | 8/2002 | Nishimura et al. |
| 6,910,245 | B2 | | 6/2005 | Hawkins et al. |
| 2004/0177467 | A1 | | 9/2004 | Jones et al. |
| 2005/0138763 | A1 | | 6/2005 | Tanner et al. |
| 2007/0180649 | A1 | | 8/2007 | Pullins |
| 2007/0214597 | A1 | | 9/2007 | Suzuki |
| 2008/0047091 | A1 | | 2/2008 | Nguyen |

FOREIGN PATENT DOCUMENTS

| | | | |
|---|---|---|---|
| EP | 1 836 941 | A2 | 9/2007 |
| JP | 2002-143060 | | 5/2002 |
| WO | WO 01/08544 | A1 | 2/2001 |

OTHER PUBLICATIONS

International Search Report for PCT International Application PCT/US2010/027637 dated May 19, 2010.

Non-final Office Action for U.S. Appl. No. 12/405,742 dated Oct. 3, 2011.

Final Office Action for U.S. Appl. No. 12/405,742 dated Mar. 26, 2012.

* cited by examiner

DUST INDICATOR FOR A VACUUM CLEANER

CROSS REFERENCE TO RELATED APPLICATIONS

This application is a national stage application filed under 35 U.S.C. 371 of International Application No. PCT/EP2011/060814, filed Jun. 28, 2011, which claims priority from Swedish Patent Application No. 1000700-3, filed Jun. 29, 2010, and U.S. Provisional Patent Application No. 61/361,093, filed Jul. 2, 2010, each of which is incorporated herein in its entirety.

FIELD OF THE INVENTION

The present invention generally relates to the field of vacuum cleaners. In particular, the present invention relates to a dust indicator for a vacuum cleaner which utilizes an airflow for keeping the dust indicator free from dust and dirt.

TECHNICAL BACKGROUND

Recently, the use of bag less vacuum cleaners, that is vacuum cleaners which do not make use of disposable dust bags, has increased. Dust from the dust laden airstream which is sucked into the vacuum cleaner is separated in a dust separation chamber and collected in a dustbin, which must be frequently emptied by the user. As long as the dust level in the dustbin is below a critical level, normal functionality of the dust separation in the vacuum cleaner is provided. However, a common problem for bag less vacuum cleaners is that the user forgets to empty the dustbin before the critical level is reached, which results in unnecessary clogging of filters and other parts of the vacuum cleaner. The consequences of this are loss of cleaning performance and increased amount of maintenance of e.g. the main filter and filter screen. Thus, there is a need for indicating to the user when it is time to empty the dustbin before the critical level is reached.

It is known to arrange optical dust indicators in vacuum cleaners for the purpose of detecting dust. The optical dust indicators are typically based on optical sensors providing a detections system, such as a light emitter in combination with a light receiver, which are arranged such that when dust is present in the optical path of the optical signal provided by the light emitter, the light detector detects a decreased or blocked light signal. The optical dust indicators are sensitive to dust getting stuck somewhere in the optical path of the detection system, as this blocks the light signal.

A dust detector utilized in a vacuum cleaner to indicate the amount of dust in a dust laden air stream is disclosed in U.S. Pat. No. 5,163,202. The dust detector is arranged in a suction passage in fluid contact with e.g. a floor nozzle of the vacuum cleaner. A light-emitting element and a light-detecting element, are arranged in a respective opening. The openings are diametrically oppositely arranged in the suction passage wall. The light-emitting element and the light-detecting element are arranged in optical communication and dust is detected when being present in the optical path of the detection system. Further, air passages guarded by pressure responsive valves are defined in the suction passage wall. These are arranged for introducing ambient air into the suction passage via the openings during operation of the vacuum cleaner. The pressure difference created between the ambient space and the suction passage during operation of the vacuum cleaner activates the valves and ambient air flushes over the light-emitting element and the light-detecting element, thereby keeping them free from dust-particles which may otherwise contaminate them. The known dust detector is quite complicated as it comprises a plurality of mechanically complex, moving constituents.

Thus, there is a need within the art for an optical dust indicator for indicating the dust level in a dustbin. In particular, it would be advantageous to have an optical dust indicator which constitutes only fixed parts and which prevents from contamination caused by dust-particles in areas overlapping its optical path.

SUMMARY OF THE INVENTION

In view of the above, an objective of the invention is to provide an improved dust indicator for a vacuum cleaner which is suitable for arranging in for instance a dustbin thereof, and which at least alleviates the problems discussed above.

One or more of these objectives are achieved by a dust indicator in accordance with the independent claim.

According to a first aspect of the invention, there is provided a dust indicator for a vacuum cleaner, the dust indicator being arranged in a wall at least partly defining a space of the vacuum cleaner that is set under negative pressure with respect to the outside of the wall during operation of the vacuum cleaner. The dust indicator comprises an air channel having an air inlet arranged at an outer side of the wall, and an air outlet arranged at an inner side of the wall. The air channel thereby provides an airflow into the space during operation of the vacuum cleaner due to the negative pressure. The dust indicator further comprises a sensor arranged for detecting dust by means of sending and/or receiving an electromagnetic signal transmitted through the space. The air channel is arranged such that the airflow prevents dust from sticking in an area of the path of the electromagnetic signal of the sensor. The dust indicator further comprises a transparent window behind which the sensor is arranged, thereby obtaining shielding of the sensor from dust and debris within the space.

Thereby, a dust indicator is provided in which the sensor for detecting the dust in a space, being for instance a dustbin, is protected from dust and debris in the dustbin by means of a transparent window arranged between the sensor and the dusty interior of the dustbin. Further, an airflow is utilized to prevent dust from sticking in the area in front of the sensor. The invention has the advantage that the airflow is created automatically when the dustbin is set under negative pressure during operation of the vacuum cleaner. Since the air channel is providing air from the outside of the dustbin, the airflow typically contains no dust, in contrast to any airflow present within e.g. the dust separation system and the dustbin of the vacuum cleaner in operation. Further, the dust indicator comprises no moving parts which makes it reliable, simple and hassle free.

According to an embodiment of the dust indicator, the airflow is directed to a clean area of the transparent window, the clean area being arranged in the path of the electromagnetic signal of the sensor. By directing the airflow to the area of the transparent window through which the electromagnetic signal of the sensor is passing, dust and dirt is prevented from sticking to this area and thereby to influence the transmission of the electromagnetic signal. Thereby, sensor functionality is improved.

According to an embodiment of the dust indicator, the airflow is arranged having an angle of incidence to the clean spot which is selected within a range of 0 to 90 degrees, which is applicable for keeping the clean area free from dust and debris.

According to an embodiment of the dust indicator, the cross-section area of the air channel varies along its extension. The shape and size of the cross-section area may be varied to fit a certain design or application of the dust indicator. Further, the shape of the air channel may be designed for creating a well defined, high speed airflow towards the clean area.

According to an embodiment of the dust indicator, the cross-section area of the air inlet is larger than the cross-section area of the air outlet. The small cross-section area of the air outlet is advantageous as it decreases the risk of dust entering the air channel from the dustbin, which risk is highest when the vacuum cleaner is turned off. This risk occurs for instance during cleaning or emptying of the dustbin, and if the vacuum cleaner is tilted, dropped or moved in a way such that dust is pressed against the air outlet.

According to an embodiment of the dust indicator, the shape of the air channel is selected from one of a rectangular shape, a bevelled shape, and a funnel shape, which is advantageous.

According to an embodiment of the dust indicator, an exit length, L, of the air channel at the air outlet is less than 5 mm.

According to an embodiment of the dust indicator, the width of the air outlet along the transparent window is larger than the height of the air outlet in a direction normal to the transparent window. The wide and low design of the air outlet provides a large clean area in relation to the cross-section area of the air channel, while at the same time keeping the airflow provided via the air channel at a minimum level.

According to an embodiment of the dust indicator, a ratio width/height of the air outlet is selected within the range 1.1-4.0.

According to an embodiment of the dust indicator, the transparent window is arranged flush with the wall.

According to an embodiment of the dust indicator, the transparent window is arranged in a countersink.

According to an embodiment of the dust indicator, the air channel and the transparent window are arranged in a cover portion arranged for being mounted in the wall. Thus, the parts of the dust indicator may be arranged in a freestanding unit which may be manufactured separately and subsequently be mounted in the wall. Further, the cover portion may be arranged to include a seating for the sensor. Thereby, the whole dust indicator may be a separate part for mounting in a wall of e.g. a dustbin.

According to an embodiment of the dust indicator, the air channel is arranged in a tubular member.

According to an embodiment of the dust indicator, it further comprises a sealing element for sealing off the sensor from the air channel and the ambient space from which the air channel guides ambient air.

According a second aspect of the inventive concept there is provided a vacuum cleaner comprising at least one dust indicator or dust indicator system comprising at least two dust indicators, in which the two indicators are arranged for facing each other and having a common path for the electromagnetic signal through the space, wherein the sensors of the dust indicators are arranged to communicate. Thus, the dust indicator may be used in a system having a separate emitter and detector which work together to detect dust.

Other objectives, features and advantages of the present invention will appear from the following detailed disclosure, from the attached claims as well as from the drawings.

Generally, all terms used in the claims are to be interpreted according to their ordinary meaning in the technical field, unless explicitly defined otherwise herein. All references to "a/an/the [member, unit, component, means, etc]" are to be interpreted openly as referring to at least one instance of the member, unit, component, means, etc., unless explicitly stated otherwise.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for identical or similar elements throughout the views, wherein.

DETAILED DESCRIPTION OF PREFERRED EMBODIMENTS

Throughout this description the exemplifying embodiments of the present inventive concept are based on optical detection of dust utilizing optical signals. This is for an illustrative purpose only. The present inventive concept is applicable for detection of dust using electromagnetic signals of other wavelengths then visible wavelengths, which is considered to fall within the scope of the present invention.

Figure 1:
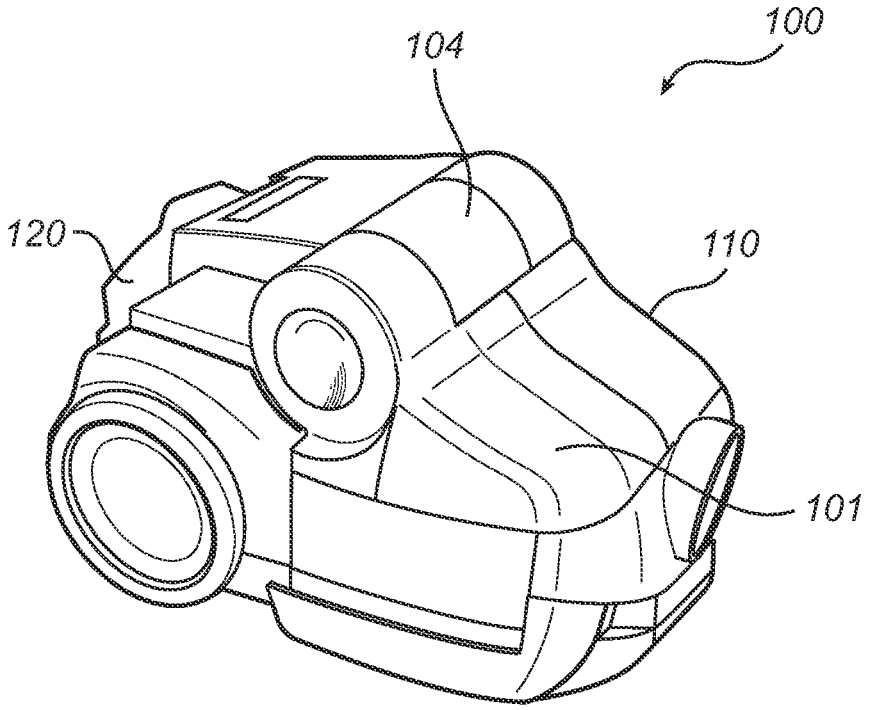
FIG. 1 is a perspective view of a vacuum cleaner comprising a dustbin provided with an embodiment of a dust indicator system according to the present invention.

FIG. 1 schematically illustrates a vacuum cleaner 100 comprising a dustbin 101 for holding dust collected from a dust-laden air stream. The dustbin 101 is detachably mounted in the vacuum cleaner 100 for enabling removal and emptying thereof. The dustbin 101 generally comprises a substantially hollow one-piece member, and is here including an inlet 103 that receives dust, dirt and air from a dirt separation chamber 104, see FIG. 2. As illustrated in FIG. 1, the vacuum cleaner 1 further comprises components such as a vacuum cleaner body 110 and a housing 120 for accommodating a power unit, etc. However, such additional components 110, 120 are not critical to the implementation of the present invention and detailed descriptions thereof are therefore omitted.

It is to be understood that the vacuum cleaner 100 further comprises a vacuum source, a suction pipe, a floor nozzle etc. (not shown) for achieving the dust and dirt cleaning capability of the vacuum cleaner, i.e. the parts needed to separate dirt from a dust laden air stream typically entered into the vacuum cleaner via the floor nozzle. However, because the dust and/or dirt sucking operation principles of the vacuum cleaner are not critical to the implementation of the present invention, detailed description thereof is omitted.

Figure 2:
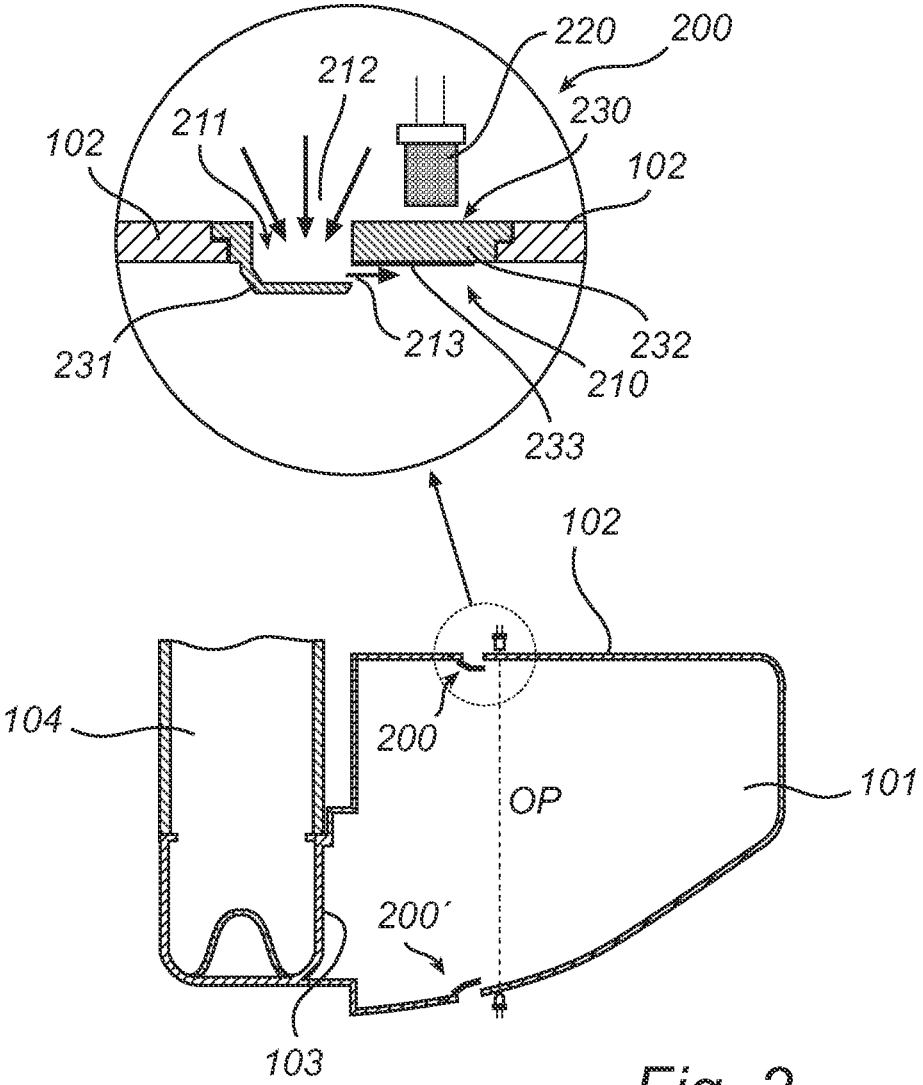
FIG. 2 is a schematic cross-sectional top view of a dustbin and a close up cross-sectional view of a dust indicator according to an exemplary embodiment of the present invention.

To continue, and now referring to FIG. 2, two dust indicators 200, 200' are arranged in opposite in the wall 102 of the dustbin 101. One of the dust indicators 200 is arranged to send an optical signal into the dustbin 101, while the opposite dust indicator 200' is arranged to receive the optical signal. That is, an optical path OP of the dust indicators 200, 200' extends through the space of the dustbin 101. As long as dirt collected in the dust bin 101 does not reach a critical level that blocks the optical path OP, the receiver, dust indicator 200', will detect a high level optical signal. As the dirt level increases it will eventually block the optical path OP, and the dust indicator 200' will detect a lower or completely blocked out optical signal. Thus an indication of the dirt level reaching a critical value is achieved. The dust indicators 200, 200' are preferably connected to a control circuit for handling the indication of the full dustbin, or are alternatively connected directly to an optical or acoustic alarm, e.g. a LED-light source or a buzzer, arranged to catch the attention of the user and to remind the user to empty the dustbin (not shown).

In the close-up top view of an embodiment of a dust indicator 200 in FIG. 2, it can be seen that the dust indicator 200 comprises a cover portion 210 arranged in the wall 102 of the dustbin 101. The cover portion 210 is here a molded plastic elongated body 230 comprising a transparent window 232 arranged flush with the wall 102, and an air channel 211 formed in the body 230 and being arranged adjacent to the transparent window 232. The air channel 211 comprises an air inlet 212 arranged at an outside of the wall 102 of the dustbin 101, and an air outlet 213 arranged at an inside of the wall 102 of the dustbin 101, thereby providing fluid communication between ambient space and the inside of the dustbin 101. The air channel 211 extends from the opening defining the air inlet 212, via an internal passage of a channel portion 231 protruding from the cover portion 210 and into the dustbin 101, and to the air outlet 213. Part of the internal passage of the channel portion is arranged in parallel and flush to the inner surface of the wall 102.

It should be emphasized that according to an embodiment of a dust indicator the cover portion is an integrated part of the wall of the dustbin. Further, although the exemplifying embodiments herein are directed to arranging the dust indicator in the wall of a dustbin of a vacuum cleaner, the present inventive concept is applicable in other spaces of the vacuum cleaner that are put under negative pressure during operation of the vacuum cleaner.

During operation of the vacuum cleaner, the vacuum source (not shown) creates a vacuum to draw air and dirt into the vacuum cleaner. This further creates a pressure difference between the dustbin and ambient space. A negative pressure in the dustbin forces ambient air from outside the dustbin 101 to flow into the dustbin 101 via the air channel 211. As the air outlet 213 (and an end portion of the air channel, which will be described below) is arranged adjacent or in the direct vicinity of the transparent window 232, the air channel 211 thereby directs air towards the transparent window 232 thereby subjecting at least a portion of the transparent window, which is defined as a clean area 233, with a jet of air. Thus, the clean area 233 is kept clean from dust particles by means of the airflow from the air channel 211, which airflow is created during operation of the vacuum cleaner.

Referring now to FIG. 2, at the transparent window 232 and outside of the dustbin 101, an optical emitter 220 is arranged and directed towards the transparent window 232 such that light emitted from the optical emitter 220 is transmitted through the transparent window 232 and into the dustbin 101. The optical emitter 220 is arranged such that its optical path OP is overlapped by the clean area 233. Thereby, dust particles are prevented from contaminating the area in front of the optical emitter 220. The optical emitter may be mounted in an integral part of the cover portion such that the dust indicator is a one piece component (not shown here) which is advantageous when assembling the vacuum cleaner. Alternatively, the one piece component may be mounted in a part of the housing of the vacuum cleaner (not shown).

During operation of the vacuum cleaner 100, the optical emitter 220 transmits an optical signal with wavelength λ, λ being a predefined wavelength or range of wavelengths within the electromagnetic spectra, e.g. visible light, a specific colour of light, infrared light (IR), or ultraviolet light (UV). By utilizing a certain wavelength of the electromagnetic signal, the dust indicator may be arranged to be less sensitive to stray light or other electromagnetic energies present in the surroundings. In addition, a decreased sensitivity to surrounding noise and reflections for the dust indicator may be provided by modulating the electromagnetic signal, e.g. by frequency modulation or any other suitable modulation technique.

For a high efficiency of the transmission of the optical signal into the dustbin 101, the material of the transparent window 232 is selected to have a high light transmission for the predefined wavelength λ.

The optical signal is sent inside the dustbin and received by the second dust indicator 200' which has basically the same structure as described for dust indicator 200 above, but which contains an optical receiver instead of an optical emitter. As long as the optical path is not blocked by dust, the optical receiver receives a high optical signal.

In an embodiment of the dust indicator, a transceiver is employed instead of a separate optical emitter or receiver. That is, the transceiver emits an optical signal into the dustbin, via the transparent window, which signal is reflected in e.g. an opposite reflecting portion arranged inside the dustbin. The reflected optical signal is detected by the transceiver. When the optical signal is blocked by dust, an indication of the dirt level reaching a critical level is provided.

Figure 3A:
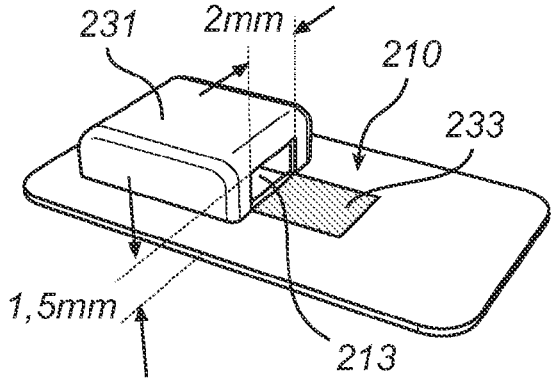
FIGS. 3*a* and 3*b* show a perspective front side view and a perspective back side view, respectively, of an embodiment of a cover portion according to the present invention.
Figure 3B:
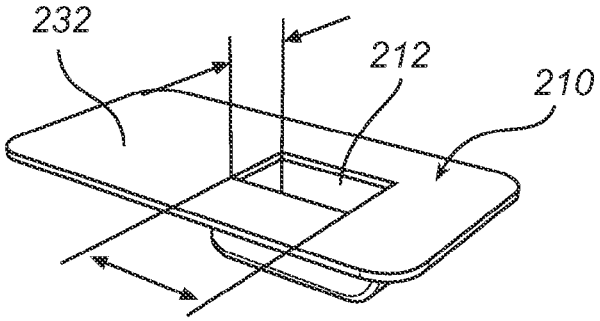

FIG. 3*a* shows a perspective front view of the cover portion 210 as seen from the inside of the dustbin 101. The protruding portion 231 is shaped substantially as a rectangular block with bevelled edges. The air outlet 213 is here a rectangular aperture having a width of 2 mm and a height of 1.5 mm. FIG. 3*b* shows a perspective back view of the cover portion 210 as seen from the outside of the dustbin 101. The air inlet 212 is here a rectangular aperture having a width of 4 mm and a height of 2 mm. The cross-section area of the air channel 211 thus varies along its extension, and the cross-section area of the air inlet 212 is larger than the cross-section area of the air outlet 213. This is to prevent dust from getting stuck in the air channel 211 when the vacuum cleaner is off. As long as the vacuum cleaner is in operation, the airflow in the air channel 211 prevents dust from the dustbin 101 of getting lodged into the air channel 211. However, when the vacuum cleaner is off and the vacuum cleaner is tilted, dropped or moved in a way that presses dust against the air outlet 213, there is a risk that dust may get stuck in the air outlet 213. The small area of the air outlet decreases this risk.

Figure 4A:
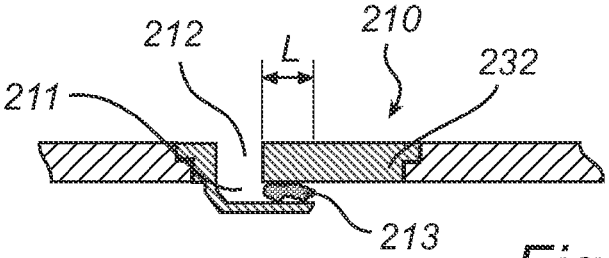
FIGS. 4*a* and 4*b* are schematic cross-sectional top views of embodiments of a cover portion according to invention.
Figure 4B:
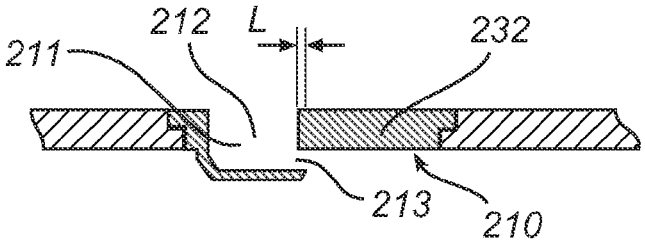

Referring now to FIGS. 4*a* and 4*b*, to further prevent dust from blocking the air outlet 213, the cross section area of the air channel 211 is arranged to rapidly change from large to small since a short exit length L of the air channel 211 at the air outlet 213 is advantageous. The exit length L is preferably selected to be less than 5 mm. Looking first at a scenario as illustrated in FIG. 4*a*, where the exit length L is long, the cross-section of the air inlet 212 is small, as compared to the scenario illustrated in FIG. 4*b*, wherein the exit length L is short and the cross-section of the air inlet 212 is large. In the first case it is more likely for dust to get caught in the exit from the air channel 211 than for the latter.

In an embodiment of the dust indicator, the width and height of the air outlet 213 is selected to be 2 mm and 1.5 mm, respectively. The dimensions of the air outlet is selected to provide a large size of the clean area 233, thus facilitating keeping the area in front of the sensor clean. Further, a ratio width/height of the air outlet is preferably selected within the range 1.1-4.0.

In the embodiments of the dust indicator, as described with reference to FIGS. 2 and 3, the air outlet 213 is arranged in a plane near the normal of the transparent window 232. The shape of the air channel is in the exemplifying embodiment herein substantially rectangular but in alternative embodiments the air channel shape may be a more bevelled shape, or a funnel shape.

Figure 5:
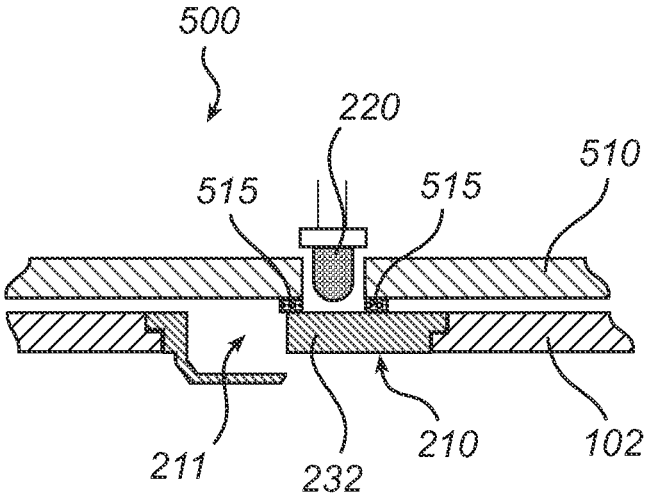
FIG. 5 is a schematic cross-sectional top view of an embodiment of a dust indicator according to the present invention.

According to an embodiment of the dust indicator 500 as illustrated in FIG. 5, the dust indicator 500 is arranged with a cover portion 210 in the wall 102 of the dustbin, similarly as previously described for the dust indicator of FIGS. 2 and 3. Here the cover portion 210 is manufactured by injection molding a plastic material. The cover portion 210 is then subsequently fastened to the dustbin wall 102 with ultrasonic welding. Another alternative is to fasten the cover portion 210 to the wall 102 by means of an adhesive. Further the sensor, i.e. the optical emitter, optical receiver, or optical transceiver, 220, is arranged at the transparent window 232 and outside a portion of the vacuum cleaner body 510. To protect the sensor 220, it is sealed off from the air channel 211, and the ambient space from which the air channel 211 guides ambient air, by means of a sealing material 515 applied between the transparent window 232 and the vacuum cleaner body 510, and encompassing the sensor 220.

In embodiments of the dust indicator, the air outlet is angled towards the transparent window, as is illustrated in embodiments described below with reference to FIGS. 6 to 8.

Figure 6:
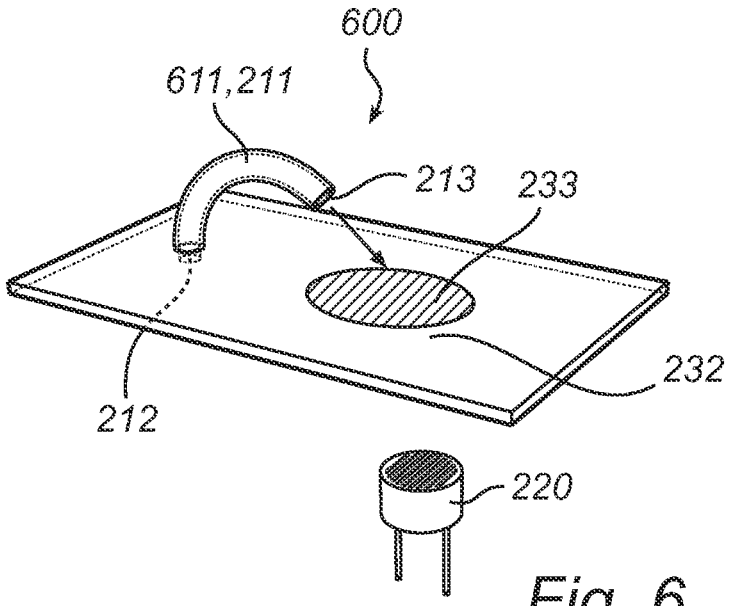
FIG. 6 is a perspective view of an embodiment of a dust indicator according to the present invention.

In FIG. 6, a dust indicator 600 having a sensor 220 arranged behind a transparent window 232, and an air channel 211 arranged in a tubular member, being a rigid tube 611 having an air inlet 212 arranged on the outer side of the dustbin and an air outlet 213 arranged inside the dustbin, is shown. The tube 611 is bent such that the air outlet 213 is directed towards the transparent window 232, thereby creating a clean area 233 in front of the sensor 220 when the airflow via the air channel 211 is present. The tube may in alternative arrangements be flexible and/or adjustable such that the angle of incidence of the airflow can be altered.

Figure 7:
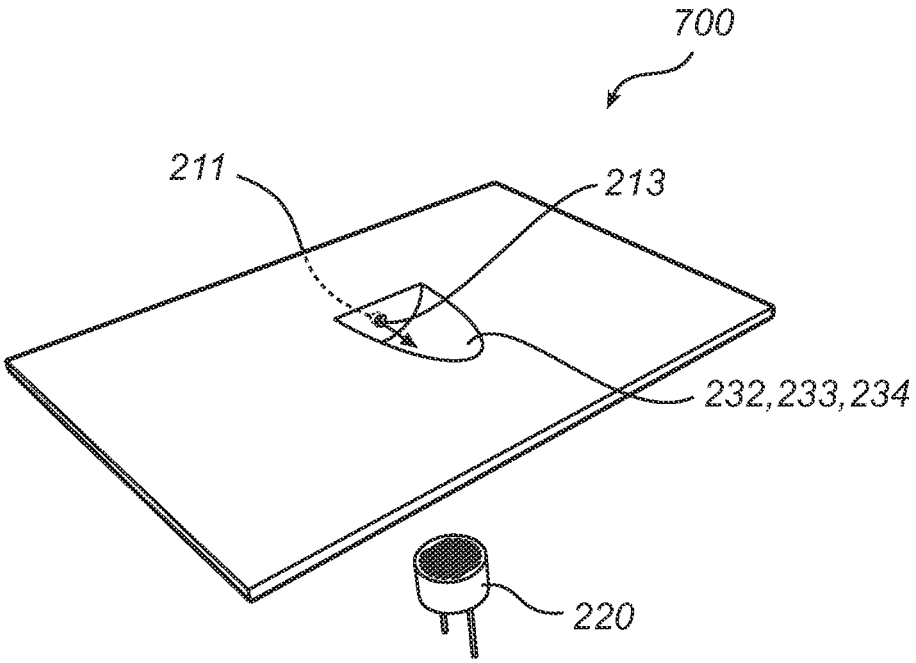
FIG. 7 is a perspective view of an embodiment of a dust indicator according to the present invention.
Figure 8:
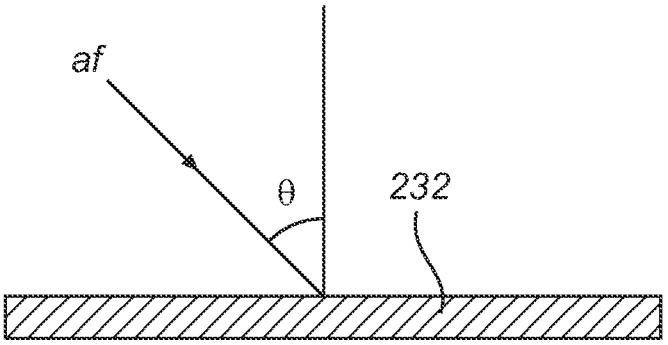
FIG. 8 is a schematic illustration of the angle of incidence of the airflow towards a transparent window.

In FIG. 7, an embodiment of the dust indicator is illustrated, in which dust indicator 700, the transparent window 232 is arranged in a tapered countersink 234 in the wall of the dustbin or alternatively in a cover portion. Further, the air channel 211 is arranged as a through hole in an opposite subportion of the countersink, which subportion is substantially perpendicular to the plane of the wall, such that the airstream exiting the air outlet 213 of the air channel 211 is inclined with respect to the transparent window 232. The respective airflow in the exemplifying embodiments of FIGS. 6 and 7, is preferably arranged having an angle of incidence θ to the clean area 233 which is selected within a range of 0 to 90 degrees. The definition of the angle of incidence θ is the angle of the incoming airflow "af" with respect to the normal of the plane of the transparent window 232, see FIG. 8.

The invention has mainly been described above with reference to a few embodiments. However, as is readily appreciated by a person skilled in the art, other embodiments than the ones disclosed above are equally possible within the scope of the invention, as defined by the appended claims.

The invention claimed is:

1. A vacuum cleaner comprising:

a dustbin having a dustbin wall, the dustbin being configured to be placed under negative pressure with respect to a surrounding atmosphere during operation of the vacuum cleaner;

a transparent window forming at least a portion of the dustbin wall;

a sensor outside the dustbin and adjacent the transparent window, the sensor comprising an electromagnetic emitter and/or detector configured to emit and/or receive an electromagnetic signal along an optical path that passes through the dustbin and through the transparent window;

an air channel passing through the dustbin wall and configured such that an airflow passes through the air channel during operation of the vacuum cleaner, the air channel being adjacent the transparent window at a location offset from the optical path, and comprising:

an air inlet at an outer side of the dustbin wall and in fluid communication with the surrounding atmosphere, a protrusion into the dustbin from an inner side of the dustbin wall, and an air outlet passing through the protrusion, the air outlet being oriented to direct the airflow towards the transparent window and across the optical path during operation of the vacuum cleaner.

2. The vacuum cleaner of claim 1, wherein the transparent window is integrally formed with the dustbin wall.

3. The vacuum cleaner of claim 1, wherein the transparent window and the air channel are formed as a separate part that is mounted in the dustbin wall.

4. The vacuum cleaner of claim 1, wherein the transparent window is flush to a surrounding portion of the dustbin wall.

5. The vacuum cleaner of claim 1, wherein the transparent window is countersunk into a surrounding portion of the dustbin wall.

6. The vacuum cleaner of claim 1, wherein the air channel has a rectangular shape, a beveled shape, or a funnel shape.

7. The vacuum cleaner of claim 1, wherein the protrusion comprises a tube.

8. The vacuum cleaner of claim 1, wherein the protrusion comprises a block with one or more beveled edges.

9. The vacuum cleaner of claim 8, wherein the air outlet comprises a rectangular aperture through the protrusion.

10. The vacuum cleaner of claim 1, wherein the air inlet has a first cross-sectional area and the air outlet has a second cross-sectional area, and the first cross-sectional area is greater than the second cross-sectional area.

11. The vacuum cleaner of claim 1, wherein the air outlet comprises an air channel that extends adjacent to and overlaps a portion of the inner side of the dustbin wall.

12. The vacuum cleaner of claim 11, wherein the air channel overlaps the inner side of the dustbin wall for a distance less than 5 millimeters.

13. The vacuum cleaner of claim 1, wherein the air outlet has a width as measured in a plane parallel to the inner side of the dustbin wall, and a height as measured in a direction perpendicular to the inner side of the dustbin wall, and the width is greater than the height.

14. The vacuum cleaner of claim 13, wherein the ratio of the width to the height is from 1.1 to 4.0.

15. The vacuum cleaner of claim 1, wherein the air outlet is arranged in plane that is perpendicular to the transparent window.

16. The vacuum cleaner of claim 1, wherein the air outlet is oriented to direct the airflow generally parallel to the transparent window.

17. The vacuum cleaner of claim 1, wherein the sensor comprises a transceiver.

18. The vacuum cleaner of claim 1, further comprising a seal configured to seal the sensor from the air channel.

19. The vacuum cleaner of claim 18, wherein the sensor is mounted to a body of the vacuum cleaner located adjacent the dustbin wall, and the seal comprises a seal positioned between the transparent window and the vacuum cleaner body.

20. The vacuum cleaner of claim 19, wherein the seal surrounds the sensor.

* * * * *